US006339051B1

(12) United States Patent
Carey et al.

(10) Patent No.: US 6,339,051 B1
(45) **Date of Patent: *Jan. 15, 2002**

(54) DIESEL ENGINE CYLINDER OILS

(75) Inventors: Vincent M. Carey, Sewell; John T. Fogarty, Mullica Hill, both of NJ (US)

(73) Assignee: Mobil Oil Corporation, Fairfax, VA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 62 days.

(21) Appl. No.: 09/095,825

(22) Filed: Jun. 11, 1998

(51) Int. Cl.[7] ..... C10M 135/10; C10M 143/06

(52) U.S. Cl. ..... 508/391; 508/291; 508/563; 508/577; 585/2; 585/3; 585/4; 585/5

(58) Field of Search ..... 585/2, 3, 4, 5, 585/10; 508/391, 291, 563, 577

(56) References Cited

U.S. PATENT DOCUMENTS

| | | | | | |
|---|---|---|---|---|---|
| 2,957,930 | A | * | 10/1960 | Jackson | 260/683.15 |
| 3,100,808 | A | * | 8/1963 | Dyer | 260/683.9 |
| 3,361,669 | A | * | 1/1968 | Westen | 508/591 |
| 3,637,503 | A | * | 1/1972 | Giannetti | 508/591 |
| 3,838,049 | A | * | 9/1974 | Souillard | 508/591 |
| 3,852,204 | A | * | 12/1974 | Souillard et al. | 508/591 |
| 3,878,115 | A | | 4/1975 | Souillard et al. | |
| 4,375,418 | A | * | 3/1983 | Zoleski et al. | 508/463 |
| 4,481,122 | A | * | 11/1984 | Root et al. | 508/591 |
| 4,948,522 | A | * | 8/1990 | Dunn et al. | 508/591 |
| 5,567,342 | A | * | 10/1996 | Inoue et al. | 508/287 |

FOREIGN PATENT DOCUMENTS

| | | | |
|---|---|---|---|
| GB | 1162172 | 9/1969 | C10M/1/18 |

OTHER PUBLICATIONS

Chemistry and Technology of Lubricants, R.M. Mortier, VCH Publishers, NY, 1992.*

* cited by examiner

*Primary Examiner*—Margaret Medley
*Assistant Examiner*—Cephia D. Toomer
(74) *Attorney, Agent, or Firm*—Malcolm D. Keen

(57) ABSTRACT

Diesel engine cylinder oils of improved cleanliness and load carrying ability and reduced port deposit characteristics for use in marine and stationary slow speed diesel engines are based on medium heavy Group I or Group II neutral base oils, typically from 300 to 500 SUS using a liquid, oil-miscible polyisobutylene (PIB) in combination with the neutral base stock and an additive package comprising a detergent component or components, an antioxidant, an antiwear agent, and a dispersant. The detergent component preferably comprises one or more overbased phenates, phenylates, salicylates or sulfonates in order to confer the desired alkalinity characteristics on the finished oil. The oils are produced in the viscosity range of 15 to 25 cS (100° C.), usually with a nominal viscosity of 20 or 24 cS, i.e., from 18.5 to 21.9 cS or 21.9 to 26.1 cS (100° C.). The viscosity index of the improved oils is at least 95, typically from 105 to 120. Total Base Number of the oils is in the range 40 to 100.

20 Claims, No Drawings

DIESEL ENGINE CYLINDER OILS

FIELD OF THE INVENTION

This invention relates to diesel engine cylinder oils.

BACKGROUND OF THE INVENTION

In large, slow speed diesel engines of the crosshead type used in marine and heavy stationary applications, the cylinders are lubricated separately from the other engine components. The cylinders are lubricated on a total loss basis with the cylinder oil being injected separately to quills on each cylinder by means of lubricators positioned around the cylinder liner. Oil is distributed to the lubricators by means of pumps which are, in modern engine designs, actuated to apply the oil directly onto the rings to reduce wastage of the oil. The high stresses encountered in these engines and the use of heavy residual fuels create the need for lubricants with a high detergency and neutralizing capability even though the oils are exposed to thermal and other stresses only for short periods of time. Residual fuels commonly used in these slow speed diesel engines typically contain significant quantities of sulfur which, in the combustion process, combines with water to form sulfuric acid, the presence of which leads to corrosive wear. Cylinder oils contain high alkalinity reserves for neutralizing this acid, which is reflected in the total base number (TBN) of these oils, typically in the range of at least 40mg KOH/g, usually from 60 to 100 mg KOH/g, which is normally adequate with fuels containing two to three percent sulfur. When higher sulfur residual fuels are being used cylinder oils with TBN values of about 70 are normally used although oils with TBN values up to and exceeding 100 mg KOH/g may be used, especially with high peak cylinder power ratings of 3,500 kw per cylinder or more.

A requirement of these cylinder oils is that they should be thin enough to spread quickly over the cylinder surface but yet thick enough to provide a continuous hydrodynamic film that will not evaporate off the walls of the upper cylinder when exposed to high combustion temperatures. Normally, oils with a viscosity grade of SAE 50 are satisfactory for lubricating both older and newer types of engine although heavier oils such as SAE 60 are contemplated. The SAE 50 grade corresponds to oils with kinematic viscosities within the range of 18.5 to 21.9 cS (100° C.), with the lower end of the range being set by engine builder specifications and the upper limit by the SAE grade sepecification. Similarly, the SAE 60 oils will have kinematic viscosities extending over the range 21.9 to 26.1 cS (100° C.). The SAE 50 oils therefore correspond to a nominal 20 cS (100° C.) oil, and the SAE 60 oils to a nominal 24 cS (100° C.) oil; oils of these grades represent the nominal viscosity targets for the oils of the present invention. Another requirement for the oils is that they should not produce deposits which will lead to port fouling. For this reason, good oxidation and thermal stability are required, manifested in actual performance by low piston ring groove packing as well as by reduced liner wear and minimized port fouling tendency.

In order to achieve the desired viscosity in the final product, relatively heavy base oils are required. Bright stock may be used to supplement the viscosity of medium heavy neutrals if extra heavy neutrals are not available to provide the desired basestock viscosity. However, bright stocks are generally unsatisfactory in cylinder oil performance because of their poor oxidative and thermal stability and although other high viscosity oils could be used to boost the basestock viscosity, for example, high viscosity synthetic polyalphaolefin (PAO's), these are very costly, given the total loss usage of the cylinder oil. Another alternative would be to increase the viscosity contribution from the additives by an increased dispersant treat rate but again, the economics are not favorable to this as a technical solution.

SUMMARY OF THE INVENTION

We have now developed improved diesel cylinder oils, useful in marine and heavy, low speed stationary diesels, which can be made from medium to medium heavy neutral base oils, typically from 300 to 500 SUS without the need for extra heavy neutrals and which can be formulated without the use of bright stock in order to provide the desired final viscosity. Compared to current commercial products, the oils according to the present invention exhibit improved deposit characteristics, improved piston cleanliness, and improved load carrying as well as providing protection against corrosive, friction and abrasive wear under severe operating conditions. In use, they are expected to result in improved engine wear characteristics as indicated by piston ring wear, cylinder liner wear, and piston ring groove packing. Port cleanliness will also be improved.

According to the present invention, the diesel cylinder oils are produced with a kinematic viscosity in the range from 15 to 27 cS (100° C.), corresponding to viscosity grades of SAE 50 or SAE 60. For these viscosity grades, the kinematic viscosity will normally be from 18.5 to 21.9 generally 19 to 21 cS (100° C.) for a nominal 20 cS oil (SAE 50) and from 21.9 to 26.1 cS (100° C.) for a nominal 24 cS oil (SAE 60). The viscosity index of the improved oils is at least 95 and usually at least 100 and may be higher, typically from 105 to 120 with most of the oils having a viscosity index in the range of 105 to 115.

The present cylinder oils use a neutral base stock of not more than 725 SUS viscosity, eliminating the need to go to extra heavy neutral base oils of higher viscosity. Normally, the base stock will comprise at least 60 wt. percent of the finished oil, usually 60 to 70 percent by weight. Because of the unique viscosity control system used in the present oils, there is no need for bright stock (which typically has a viscosity of at least 25 cS at 100° C. and in most cases at least 30 cS at 210° F.) to be used in order to obtain the desired final viscosity. Because of the its inferior stability, bright stock is not a preferred option for viscosity control and if used at all, for example with the lightest neutrals, should be used in only minor amounts, typically not more than ten percent by weight of the formulation. The neutrals used as the main component of the oil will normally have viscosities in the range of 300 to 700, preferably 300 to 600 SUS (100° F.) although with the lower viscosity neutrals, it will be necessary to use a higher treat rate for the viscosity control component and possibly also of the other additives in order to achieve the final product viscosity.

The neutral base stocks will normally be API Group I or Group II base stocks; in view of the total loss usage of the cylinder oils, there is no advantage to the use of the higher quality Group III base stocks and, in fact, because of additive solvency problems associated with the highly paraffinic character of the Group III stocks, they are not normally preferred. Group I base stocks contain less than 90 percent saturates and/or greater than 0.03 percent sulfur and have a viscosity index greater than or equal to 80 and less than 120. Group II base stocks contain greater than or equal to 90 percent saturates and less than or equal to 0.03 percent sulfur with a viscosity index greater than or equal to 80 and less than 120.

A feature of the present cylinder oils is the use of polyisobutylene (PIB) in combination with the neutral base stock. The amount of PIB will normally be from 1 to 20 wt. percent of the finished oil, generally from 2 to 15 wt. percent, and in most cases from 4 to 12 wt. percent of the finished oil. Polyisobutylene is a commercially available material from several manufacturers. The PIB used in the present formulations is a viscous oil-miscible liquid, with a weight molecular weight in the range of 1,000 to 8,000, usually 1,500 to 6,000, and a viscosity in the range of typically 2,000 to 5,000 or 6,000 cS (100° C.) (ASTM D-445). In most cases, the molecular weight will be in the range of 2,000 to 3,000 or 5,000 and the kinematic viscosity should be selected to be in the range of 3,000 to 4,500 cS. The more viscous PIB's may be used to provide a greater contribution to product viscosity than the less viscous ones, and may therefore be used preferentially with the lighter neutral base stocks, for example, the 300–500 SUS neutrals. In addition, the higher viscosity PIB's e.g., the PIB's of over 4,000 cS viscosity may be used in lower amounts, resulting in improved product economics. Typically, the PIB's with a viscosity in the range of 3,000 to 5,000 cS will be used in amounts from about 4 to 6 wt. percent of the finished formulation, using neutral base stocks in the range of 500 to 600 SUS. With base stocks below 500 SUS, from 5 to 12 percent of the PIB will normally be satisfactory, the amount selected being dependent on the viscosity of the polymer.

In addition to the neutral base stock and the PIB component, the cylinder oils also contain an additive package comprising a detergent component or components, an antioxidant, an antiwear agent, a dispersant, all of which are conventional in type, usage and treat rates. The detergent component or components preferably comprise one or more overbased phenates, phenylates, salicylates or sulfonates in order to confer the desired detergency and alkalinity characteristics on the finished oil. The overbased phenates and sulfonates are the preferred overbased detergents, used alone or in combination with one another. These overbased metal salts are normally based on sodium, magnesium or calcium or barium, with preference given to calcium. The preferred detergents are the phenates with TBN values of at least 200, preferably at least 250, sulfonates with TBN values of at least 300 preferably at least 350 and mixtures of these. The total base number (mg KOH/g) for all the components of the detergent package should be at least 100 and preferably at least 200. Commercially available phenates sulfonates of these types with TBN valuies in the range of 100 to 500 are readily available commercially and are suitable. Commercial detergents normally contain an added defoamant, usually a silicone defoamant so that a defoamant component is normally also present in the finished oils.

The total amount of the detergent package will normally be in the range of 15 to 35, generally 17 to 32, weight percent of the total lubricant, usually from 22 to 28 percent.

In addition to the detergent package, the oils also include a dispersant. The preferred class of dispersants are the succinimides, which are the acylated amines or derivatives obtained by reaction of a carboxylic acylating agent, preferably a hydrocarbon-substituted succinic acid acylating agent with at least one amine containing a hydrogen attached to a nitrogen group. The nitrogen-containing carboxylic dispersants useful in the present cylinder oils are conventional in type; they are widely commercially available and have been described in many U.S. patents including U.S. Pat. Nos. 3,172,892; 3,341,542; 3,630,904; 3,215,707; 3,444,170 3,632,511; 3,219,666; 3,454,607; 3,787,374; 3,316,177; 3,541,012 and 3,234,435. The preferred succinimide dispersants of this type are generally represented by succinimides (e.g., polyisobutylene succinic acid/anhydride (PIBSA)-polyamine having a PIBSA molecular weight of about 700 to 2500). The dispersants may be borated or non-borated. Metal-blocked succinimides such as the zinc-blocked succinimides have better thermal stability and are preferred. The dispersant can be present in the amount of about 0.5 to 5 weight percent, more preferably in the amount of about 0.5 to 2 weight percent, e.g. 1 weight percent.

The oils also contain an antioxidant component in order to stablize the oil and prevent deposit formation under the high temperatures encountered in the combustion chamber. The antioxidant may be either phenolic or aminic in character. The preferred phenolic compounds are the hindered phenoloics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with tertiary alkyl groups and the alkylene coupled derivatives of these hindered phenols. Examples of phenolic materials of this type include materials such as the tertiary alkylphenols e.g., o,o'-ditertiary alkyl phenols such as ditert-butyl phenol. 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-di-t-butyl-4-heptyl phenol; and 2-methyl-6di-t-butyl-4-dodecyl phenol. Examples of ortho coupled phenols include: 2,2'-bis(6-t-butyl-4-heptyl phenol); 2,2'-bis(6-t-butyl-4-octyl phenol); and 2,2'-bis(6-t-butyl4-dodecyl phenol).

Non-phenolic oxidation inhibitors, especially the aromatic amine antioxidants may also be used either as such or in combination with the phenolics. Typical examples of non-phenolic antioxidants include: alkylated and non-alkylated aromatic amines such as the aromatic monoamines of the formula $R^3R^4R^5$ N where $R^3$ is an aliphatic, aromatic or substituted aromatic group, $R^4$ is an aromatic or a substituted aromatic group, and $R^5$ is H, alkyl, aryl or $R^6S(O)$ x $R^7$ where $R^6$ is an alkylene, alkenylene, or aralkylene group, $R^7$ is a higher alkyl group, or an alkenyl, aryl, or alkaryl group, and x is 0, 1 or 2. The aliphatic group $R^3$ may contain from 1 to about 20 carbon atoms, and preferably contains from 6 to 12 carbon atoms. The aliphatic group is a saturated aliphatic group. Preferably, both $R^3$ and $R^4$ are aromatic or substituted aromatic groups, and the aromatic group may be a fused ring aromatic group such as naphthyl. Aromatic groups $R^3$ and $R^4$ may be joined together with other groups such as S.

Typical aromatic amine antioxidants have alkyl substituent groups of at least 4 carbon atoms. Examples of aliphatic groups include butyl, hexyl, heptyl, octyl, nonyl, and decyl. Generally, the aliphatic groups will not contain more than 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: the dialkyl diphenyl amines such as dibutyl, octyl buty, or dioctyl diphenyl amine, p,p'-dioctyldiphenylamine; octylphenyl-beta-naphthylamine; t-octylphenyl-alpha-naphthylamine; phenyl-alphanaphthylamine; phenyl-beta-naphthylamine; p-octyl phenyl-alpha-naphthylamine; 4-octylphenyl-1-octyl-beta-naphthylamine. In these amines, the alkyl substituents are usually sterically hindered tertiary alkyl groups.

Normally, the total amount of antioxidant will not exceed 1 wt. percent of the total composition and normally will be not more than 0.5 wt. percent. Usually, from 0.3 to 0.5 wt. percent antioxidant is suitable.

It is desirable to include an antiwear agent in the oils in order to reduce piston ring and cylinder liner wear and provide cylinder liner scuffing protection; for this purpose the sulfur-containing antiwear agents are preferred. Antiwear additives such as the metal dithiophosphates (e.g., zinc dialkyl dithiophosphate, ZDDP), metal dithiocarbamates, metal xanthates or tricrecylphosphate, as a non-sulfur containing antiwear agent, may be included. The sulfurized olefins such as sulfurized isobutylene also consitute a useful class of antiwear agents that are of utility in these cylinder oils and are readily available commercially. The antiwear additives can be present in the amount of 0.01 to 1.0 weight percent, usually 0.05 to 0.25 weight percent.

Other conventional additives may be present for their own functionality, if desired. Preferred examples of the cylinder oils would be a nominal 20 cS (100° C.) marine diesel cylinder oil with a viscosity index of at least 100, a total base number of at least 70 mg KOH/g comprising, in weight percent, from 65 to 70 percent of a neutral base oil having a viscosity from 400 to 600 SUS (100° C.) and a viscosity index of at least 80, from 4 to 6 percent of a polyisobutylene having a viscosity from 4,000 to 4,500 cS (100° C.), from 20 to 25 percent of an overbased detergent package comprising a combination of an overbased phenate having a TBN of at least 250 and a sulfonate detergent having a TBN of at least 400, from 0.5 to 2.0, preferably 0.5 to 1.0, percent of a polyisobutenyl substituted succinimide dispersant, from 0.1 to 0.5 percent of a sulfurized isobutylene antiwear agent, and from 0.1 to 1.0 percent of an aromatic amine antioxidant. An alternative nominal 20 cS (100° C.) marine diesel cylinder oil with a viscosity index of at least 100 and a total base number of at least 70 mg KOH/g would comprise, in weight percent, from 60 to 65 percent of a neutral base oil having a viscosity from 300 to 400 SUS (100° C.) and a viscosity index of at least 80, from 8 to 12 percent of a polyisobutylene having a viscosity from 3,000 to 3,500 cS (100° C.), from 20 to 28 percent of an overbased detergent package comprising a combination of the overbased phenate (TBN at least 250) and the sulfonate (TBN at least 400), from 0.5 to 2.0 percent of the succimide dispersant, from 0.1 to 0.5 percent of the antiwear agent, and from 0.1 to 1.0 percent of the aromatic amine antioxidant.

In terms of performance, the present cylinder oils exhibit improved piston ring and cylinder liner wear characteristics compared to previous cylinder oils and they are notably improved in respect to piston groove packing ratings and other performance characteristics desirable in cylinder oils for slow speed diesel engines. These improvements in performance are demonstrated in the following comparative examples.

EXAMPLE 1

An oil according to the present invention was formulated and compared in bench and engine testing with a known cylinder oil (Comparative Oil A). The compositions and test results are shown below in Table 1.

TABLE 1

| | Comp. Oil A | Example 1 | Effect of PIB |
|---|---|---|---|
| Formulation Comparison | | | |
| Component Description, wt. pct. | | | |
| Phenate (255 TBN) | 17.70 | 17.70 | |
| Sulfonate-1 (300 TBN) | 8.30 | | |
| Sulfonate-2 (400 TBN) | | 6.50 | |
| Dispersant, succinimide type | 1.00 | 1.00 | |
| Antiwear, sulf. olefin type | 0.10 | 0.10 | |
| Antioxidant, diphenylamine type | 0.40 | 0.40 | |
| 850N Base Oil, Group 1 | 72.50 | | |
| 600N Base Oil, Group 1 | | | |
| 500N Base Oil, Group 1 | | 69.80 | |
| 500N Base Oil, Group 2 | | | |
| 300N Base Oil, Group 1 | | | |
| Polyisobutylene. | | 4.50 | |
| Performance Characteristics | | | |
| KV @ 100 C., cSt | 20.5 | 20.5 | Maintain KV |
| Viscosity Index | 101 | 106 | Improved |
| B-10 Visc Increase | 27 | 31 | Equal |
| Hot Tube Rating | 3 | 4 | Equal |
| 30-day Storage Haze/Deposits | Nil/Nil | Nil/Nil | Equal |
| Oven Gel Deposits | None | None | Equal |
| Water Separation, % Clear Oil | 99.0 | 98.9 | Equal |
| Full-Scale Engine Testing | | | |
| Max Ring Wear, mm/1000 hrs | 0.35 | 0.30 | Improved |
| Max Liner Wear, mm/1000 hrs | 0.08 | 0.06 | Improved |
| Piston Demerit Rating | 2.4 | 2.3 | Equal |
| Piston Top Groove Fill, % | 57 | 46 | Improved |

Polyisobutylene, m.w. 2,000–2,500, KV (99° C.) 4069–4382

EXAMPLE 2

A further comparison was made between a two conventional commercial cylinder oils and an oil according to the invention.

TABLE 2

| | Comp. Oil B | Comp. Oil C | Example 2 | Effect of PIB |
|---|---|---|---|---|
| Formulation Comparison | | | | |
| Component Description, wt. pct. | | | | |
| Phenate (255 TBN) | 17.70 | 17.70 | 17.70 | |
| Sulfonate-1 (300 TBN) | 8.30 | | | |
| Sulfonate-2 (400 TBN) | | 6.50 | 6.50 | |
| Dispersant, succinimide type | 1.00 | 1.00 | 1.00 | |
| Antiwear, sulf. olefin type | 0.10 | 0.10 | 0.10 | |
| Antioxidant, diphenylamine type | 0.40 | 0.40 | 0.40 | |
| 850N Base Oil, Group 1 | 72.50 | 74.30 | | |
| 600N Base Oil, Group 1 | | | | |
| 500N Base Oil, Group 1 | | | | |
| 500N Base Oil, Group 2 | | | 69.80 | |
| 300N Base Oil, Group 1 | | | | |
| Polyisobutylene | | | 4.50 | |
| Performance Characteristics | | | | |
| KV @ 100 C., cSt | 20.5 | 20.5 | 20.5 | Maintain KV |
| Viscosity Index | 101 | 101 | 114 | Improved |
| B-10 Visc Increase | 27 | 26 | 26 | Equal |
| Hot Tube Rating | 3 | 4 | 10 | Poorer (1) |
| 30-day Storage Haze/Deposits | Nil/Nil | Nil/Nil | Nil/Nil | Equal |
| Oven Gel Deposits | None | None | None | Equal |
| Water Separation, % Clear Oil | 99.0 | 98.7 | 98.6 | Equal |
| Full-Scale Engine Testing | | | | |
| Max Ring Wear, mm/1000 hrs | 0.52 | — | 0.54 | Equal |
| Max Liner Wear, mm/1000 hrs | 0.05 | — | 0.10 | Poorer |
| Piston Demerit Rating | 3.4 | — | 3.0 | Improved |
| Piston Top Groove Fill, % | 61 | — | 35 | Improved |

Notes:
(1) Poorer result due to effect of specific base stock.
Polyisobutylene, m.w. 2,000–2,500, KV (99° C.) 4069–4382

EXAMPLE 3

A comparison was made between Comparison Oil C and another oil according to the invention.

TABLE 3

| | Comp. Oil C | Example 3 | Effect of PIB |
|---|---|---|---|
| Formulation Comparison | | | |
| Component Description, wt. pct. | | | |
| Phenate (255 TBN) | 17.70 | 17.70 | |
| Sulfonate-1 (300 TBN) | | | |
| Sulfonate-2 (400 TBN) | 6.50 | 6.50 | |
| Dispersant, succinimide type | 1.00 | 1.00 | |
| Antiwear, sulf. olefin type | 0.10 | 0.10 | |
| Antioxidant, diphenylamine type | 0.40 | 0.40 | |
| 850N Base Oil, Group 1 | 74.30 | | |
| 600N Base Oil, Group 1 | | | |
| 500N Base Oil, Group 1 | | | |
| 500N Base Oil, Group 2 | | | |
| 300N Base Oil, Group 1 | | 63.10 | |
| Polyisobutylene | | 11.20 | |
| Performance Characteristics | | | |
| KV @ 100 C., cSt | 20.5 | 20.5 | Maintain KV |
| Viscosity Index | 101 | 113 | Improved |
| B-10 Visc Increase | 26 | 41 | Sl. Poorer |
| Hot Tube Rating | 4 | | |
| 30-day Storage Haze/Deposits | Nil/Nil | Trace/Nil | Equal |
| Oven Gel Deposits | None | None | Equal |
| Water Separation, % Clear Oil | 98.7 | N/R | — |
| Full-Scale Engine Testing | | | |
| Max Ring Wear, mm/1000 hrs | 0.44 | 0.45 | Equal |
| Max Liner Wear, mm/1000 hrs | 0.06 | 0.05 | Improved |

TABLE 3-continued

| | Comp. Oil C | Example 3 | Effect of PIB |
|---|---|---|---|
| Piston Demerit Rating | 3.4 | 2.9 | Improved |
| Piston Top Groove Fill, % | 60 | 53 | Improved |

Polyisobutylene, m.w. 2060 av., KV (99° C.) 3026–3381

Outline of Test Procedures

In the B-10 test, 50 ml. of oil is placed in a glass all together with iron, copper, and aluminum catalysts and a weight lead corrosion specimen. The cell and its contents are placed in a bath maintained at 191° C. and 10 liters/hr of dried air is bubbled through the sample for 24 hours. The cell is removed from the bath and the catalyst assembly is removed from the cell. The oil is examined for the presence of sludge and the Kinematc Viscosity at 100° C. (ASTM D 445) determined. The lead specimen is cleaned and weighed to determine the loss in weight.

Hot Tube Test

Lubricating oil and house air are fed at controlled rates through a heated Pyrex® glass capillary tube. The oil and air are brought together via a Pyrex® glass tee that is connected to the bottom of the capillary tube. As the oil is metered into the glass tee, the air picks up the oil and carries it up through the vertical glass capillary tube which passes through an electrically heated and temperature controlled aluminum block. The heated oil and air mixture then exits from the top of the the glass capillary into a collecting beaker for the oxidized oil. At test completion, the glass capillary tubes are removed from the heating block then flushed with ASTM naphtha and rated for lacquer and carbon deposits, using reference standards. A rating scale from 1 to 10 is used, 1 being clean and 10 being the worst with heavy black carbon/coke deposits.

We claim:

1. A diesel cylinder oil, having a viscosity of 15 to 27 cS, a viscosity index of at least 95 and a total base number of at least 40 mg KOH/g, which comprises a neutral base stock of no more than 725 SUS viscosity (100° F.) and having a viscosity index of at least 80, from 2 to 15 wt. % of the oil of a oil soluble, liquid polyisobutylene having a viscosity from 1,500 to 8,000 cS (100° C.) and an antioxidant component component.

2. A diesel cylinder oil according to claim 1 which comprises from 60 to 70 wt. percent of a base stock oil having a viscosity of 300 to 700 SUS (100° F.).

3. A diesel cylinder oil according to claim 2 which comprises 60 to 70 percent by weight of a basestock oil comprising a 300 to 600 SUS (100° F.), API Group I or Group II oil.

4. A diesel cylinder oil according to claim 1 having a viscosity of 19 to 21 cS (100° C.).

5. A diesel cylinder oil according to claim 4 which is a nominal 20 cS (100° C.) oil.

6. A diesel cylinder oil according to claim 1 which includes from 4 to 12 wt. percent of the oil of a polyisobutylene having a viscosity of 2,000 to 5,000 cS (100° C.).

7. A diesel cylinder oil according to claim 6 in which the polyisobutylene has a molecular weight from 2,000 to 3,000.

8. A diesel cylinder oil according to claim 1 which has a total base number of 40 to 100 mg KOH/g.

9. A diesel cylinder oil according to claim 1 which includes an additive package comprising at least one overbased detergent having a TBN of at least 200 mg KOH/g, a dispersant and antiwear agent.

10. A diesel cylinder oil according to claim 9 in which the detergent comprises an overbased phenate, an overbased sulfonate or a combination of an overbased phenate and an overbased sulfonate.

11. A diesel cylinder oil according to claim 10 in which the overbased phenate has a total base number of at least 250 and the overbased sulfonate has a total base numbers of at least 350 mg KOH/g.

12. A diesel cylinder oil according to claim 10 which includes from 15 to 35 wt. percent of the combination of the overbased phenate and overbased sulfonate.

13. A diesel cylinder oil according to claim 9 wherein the antioxidant is a phenolic or an aromatic amine antioxidant.

14. A diesel cylinder oil according to claim 12 which includes a succinimde dispersant.

15. A diesel cylinder oil according to claim 10 which includes a sulfur containing antiwear agent.

16. A diesel cylinder oil according to claim 1 which contains not more than 10 weight percent bright stock as base stock.

17. A diesel cylinder oil according to claim 1 which has a viscosity index of 95 to 115.

18. A diesel cylinder oil according to claim 1 which is a nominal 20 cS (100° C.) marine diesel cylinder oil having a viscosity index of at least 100, a total base number of at least 70 mg KOH/g and which comprises, in weight percent, from 65 to 70 percent of a neutral base oil having a viscosity from 400 to 600 SUS (100° F.) and a viscosity index of at least 80, from 4 to 6 percent of a polyisobutylene having a viscosity from 4,000 to 4,500 cS (100° C.), from 20 to 25 percent of an overbased detergent package comprising a combination of an overbased phenate having a TBN of at least 250 and a sulfonate detergent having a TBN of at least 400, from 0.5 to 2.0 percent of a polyisobutenyl substituted succimide dispersant, from 0.1 to 0.5 percent of a sulfurized isobutylene antiwear agent, and from 0.1 to 1.0 percent of an aromatic amine antioxidant.

19. A diesel cylinder oil according to claim 1 which is a nominal 20 cS (100° C.) marine diesel cylinder oil having a viscosity index of at least 100, a total base number of at least 70 mg KOH/g and which comprises, in weight percent, from 65 to 70 percent of a neutral base oil having a viscosity from 400 to 600 SUS (100° F.) and a viscosity index of at least 80, from 4 to 5 percent of a polyisobutylene having a viscosity from 4,000 to 4,500 cS (100° C.), from 20 to 25 percent of an overbased detergent package comprising a combination of an overbased phenate having a TBN of at least 250 and a sulfonate detergent having a TBN of at least 400, from 0.5 to 1.0 percent of a polyisobutenyl substituted succimide dispersant, from 0.1 to 0.5 percent of a sulfurized isobutylene antiwear agent, and from 0.1 to 0.5 percent of an aromatic amine antioxidant.

20. A diesel cylinder oil according to claim 1 which is a nominal 20 cS (100° C.) marine diesel cylinder oil having a viscosity index of at least 100, a total base number of at least 70 mg KOH/g and which comprises, in weight percent, from 60 to 65 percent of a neutral base oil having a viscosity from 300 to 400 SUS (100° F.) and a viscosity index of at least 80, from 8 to 12 percent of a polyisobutylene having a viscosity from 3,000 to 3,500 cS (100° C.), from 20 to 28 percent of an overbased detergent package comprising a combination of an overbased phenate having a TBN of at least 250 and a sulfonate detergent having a TBN of at least 400, from 0.5 to 2.0 percent of a polyisobutenyl substituted succimide dispersant, from 0.1 to 0.5 percent of a sulfurized isobutylene antiwear agent, and from 0.1 to 1.0 percent of an aromatic amine antioxidant.

* * * * *

UNITED STATES PATENT AND TRADEMARK OFFICE

CERTIFICATE OF CORRECTION

PATENT NO. : 6,339,051 B1
DATED : January 15, 2002
INVENTOR(S) : Carey et al.

It is certified that error appears in the above-identified patent and that said Letters Patent is hereby corrected as shown below:

Title page,
Item [*] Notice, delete the phrase "by 62 days" and insert -- by 0 days --

Signed and Sealed this

Eleventh Day of May, 2004

JON W. DUDAS
*Acting Director of the United States Patent and Trademark Office*